US006279178B1

(12) United States Patent
Hill

(10) Patent No.: US 6,279,178 B1
(45) Date of Patent: Aug. 28, 2001

(54) BATHING CHAIR

(76) Inventor: Jimmy Hill, 4480 Old Guernsey Rd., Pace, FL (US) 32571

( * ) Notice: Subject to any disclaimer, the term of this patent is extended or adjusted under 35 U.S.C. 154(b) by 0 days.

(21) Appl. No.: 09/709,376

(22) Filed: Nov. 13, 2000

(51) Int. Cl.[7] ..... A47K 3/022
(52) U.S. Cl. ..... 4/578.1; 4/560.1
(58) Field of Search ..... 4/560.1, 571.1, 4/578.1, 579, 505

(56) References Cited

U.S. PATENT DOCUMENTS

| | | | | |
|---|---|---|---|---|
| 2,648,849 | * | 8/1953 | Webb et al. | 4/560.1 |
| 3,582,999 | * | 6/1971 | Baker | 4/505 |
| 4,091,479 | * | 5/1978 | Hancock | 4/560.1 |
| 4,359,791 | | 11/1982 | Thomas | 4/546 |
| 4,472,844 | | 9/1984 | Mace | 4/579 |
| 5,097,542 | | 3/1992 | Roesler | 4/579 |
| 5,335,377 | * | 8/1994 | Masyada et al. | 4/578.1 |
| 5,373,591 | * | 12/1994 | Myers | 4/578.1 |
| 5,517,704 | | 5/1996 | Dagostino | 4/560.1 |
| 5,558,022 | | 9/1996 | Mason et al. | 104/126 |
| 5,561,868 | | 10/1996 | Campbell | 4/560.1 |
| 6,035,459 | * | 3/2000 | Sadek | 4/560.1 |
| 6,094,756 | * | 8/2000 | Carter | 4/578.1 |

* cited by examiner

*Primary Examiner*—Charles R. Eloshway
(74) *Attorney, Agent, or Firm*—Peter Loffler

(57) ABSTRACT

A bathing chair gives a user maximum comfort and versatility while using the device. The bathing chair has a rotatable seat with a reclining back member and a reclining leg member attached thereto. A roller assembly attachable to a hand rail prevents the bathing chair from tipping over. Conduits disposed within the seat member and the back member allow warm water to be channeled therethrough in order to provide heating for the user. A waste pan and a cart are removably attachable to the bathing chair.

18 Claims, 8 Drawing Sheets

BATHING CHAIR

BACKGROUND OF THE INVENTION

1. Field of the Invention

The present invention relates to a multifunction bathing chair used in bathtubs and showers.

2. Background of the Prior Art

The utility of providing a chair for use by the physically challenged or the infirm while within a bathtub or shower environment has long been known. Many bathtub and shower chairs can be found in the art. However, such prior art devices have one or more drawbacks.

Many prior art devices have limited utility beyond providing the seating function making such devices relatively less versatile. On the other hand, some devices are unusually complex in design making these relatively expensive to build and maintain. Still other bathing chairs are unduly difficult to operate. These chairs are intimidating to the targeted users requiring the users to employ a skilled worker which is generally not feasible for chairs that are used in home as opposed to institutional settings.

Therefore, there is a need in the art for a chair used in a bathtub or shower environment that overcomes the drawbacks found in prior art devices. Such a chair must have a range of functionality and must be relatively simple in design and operation and must be usable by most individuals unassisted. Ideally, such a bathtub and shower chair will also provide functionality to a caregiver if one is employed.

SUMMARY OF THE INVENTION

The bathing chair of the present invention addresses the aforementioned needs in the art. The bathing chair is a multifunctional chair for use in either a bathtub or a shower environment. The bathing chair is of relatively simple design and construction and is made using standard manufacturing techniques. The device is relatively simple to operate and can be used by most individuals unassisted. If a caregiver is providing assistance, the device is user-friendly to the caregiver.

The bathing chair of the present invention is comprised of a base having a a first side, a second side, a front, a back, a top, and a bottom. A plurality of first legs extend downwardly from the bottom of the base. A seat is attached to the top of the base. An arm extends outwardly from the first side of the base while a pair of generally parallel oriented rollers are attached to an end of the arm, the rollers adapted to encompass a guide rail therebetween. The seat may be rotatably attached to the base. The seat is comprised of a seat member and a back member wherein the back member is pivotally attached to the seat member. A head rest may be attached to the back member. A first conduit is disposed within the seat member, the first conduit having a first inlet port adapted to be attached to a source of pressurized water, and a first outlet port while a second conduit is disposed within the back member, the second conduit having a second inlet port adapted to be attached to the source of pressurized water, and a second outlet port. The first outlet port may be fluid flow connected to the second inlet port (or the second outlet port may be fluid flow connected to the first inlet port). A first opening is disposed within the base while a second opening is disposed within the seat and corresponds with the first opening. A pair of rails are attached to the bottom of the base in spaced apart fashion on opposing sides of the first opening and a pan is slidably disposed on the pair of rails. A plurality of first castors are each attached to a respective one of the plurality of first legs. A leg member is pivotally attached to the front of the seat. A cart having a plurality of second legs, is attached to the second side of the base. A plurality of second castors, are each attached to a respective one of the plurality of first legs.

BRIEF DESCRIPTION OF THE DRAWINGS

Similar reference numerals refer to similar parts throughout the several views of the drawings.

DESCRIPTION OF THE PREFERRED EMBODIMENT

Figure 1:
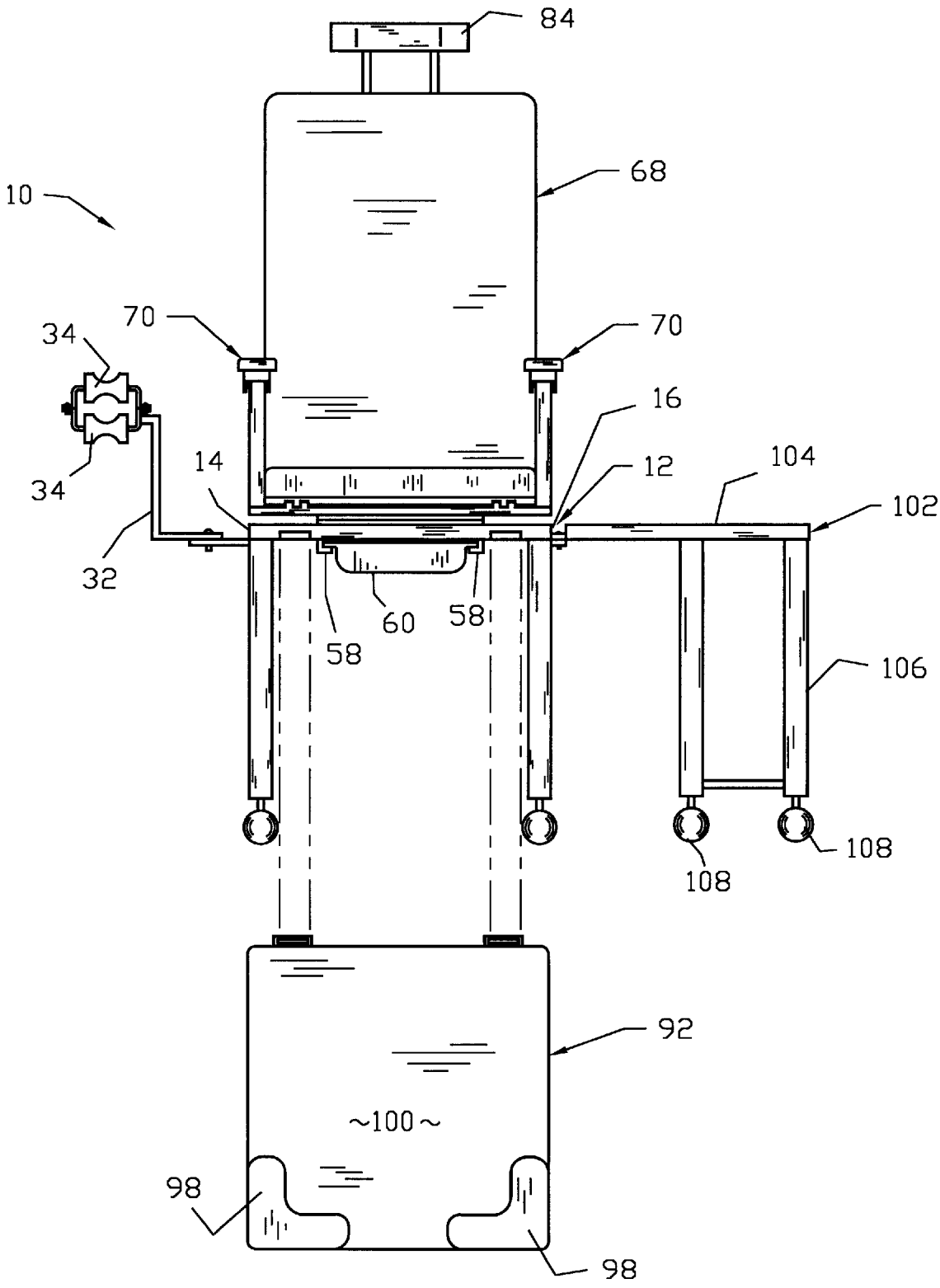
FIG. 1 is a front elevation view, partially exploded, of the bathing chair of the present invention.
Figure 2:
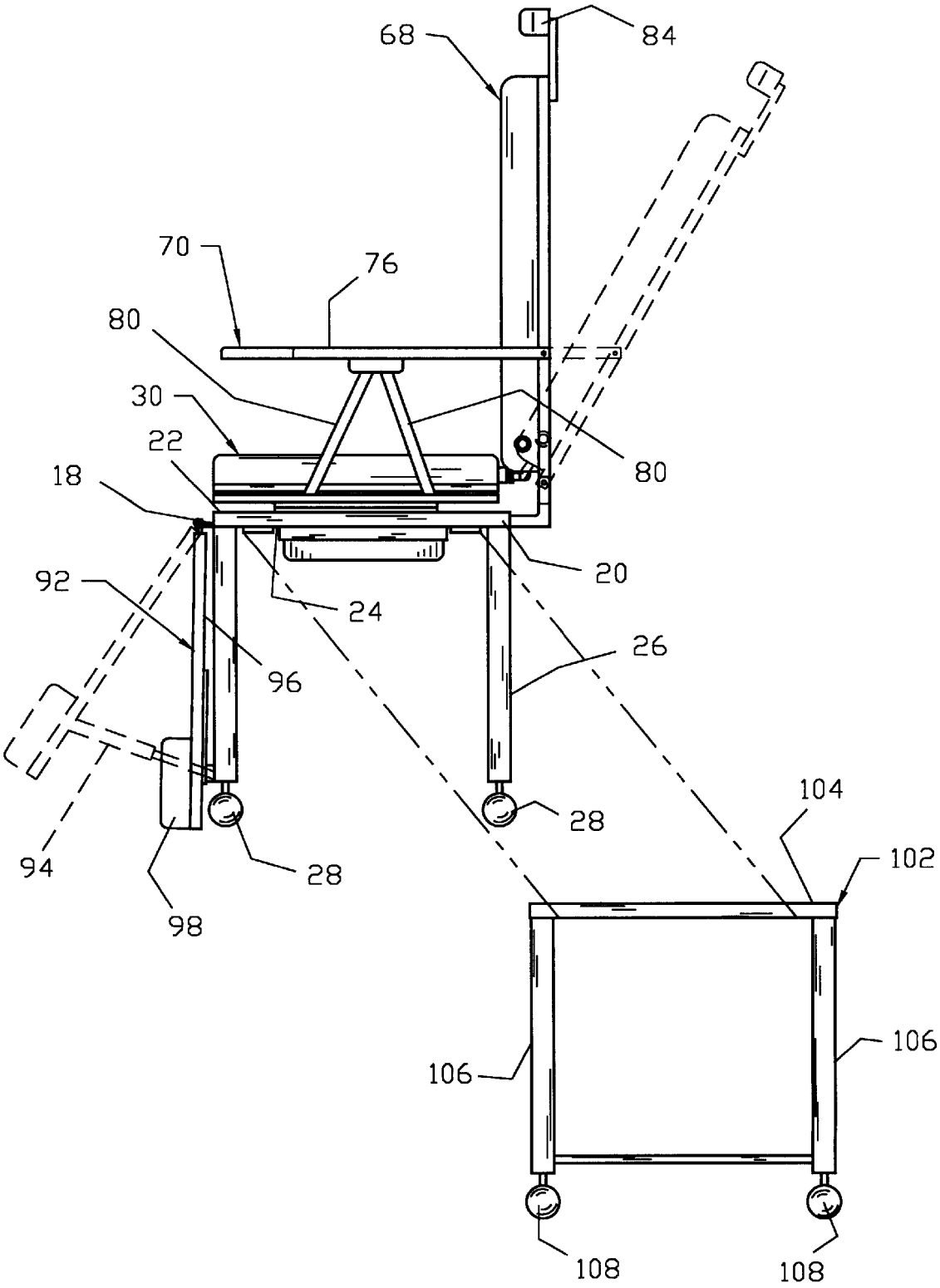
FIG. 2 is a side elevation view, partially exploded, of the bathing chair.
Figure 3A:
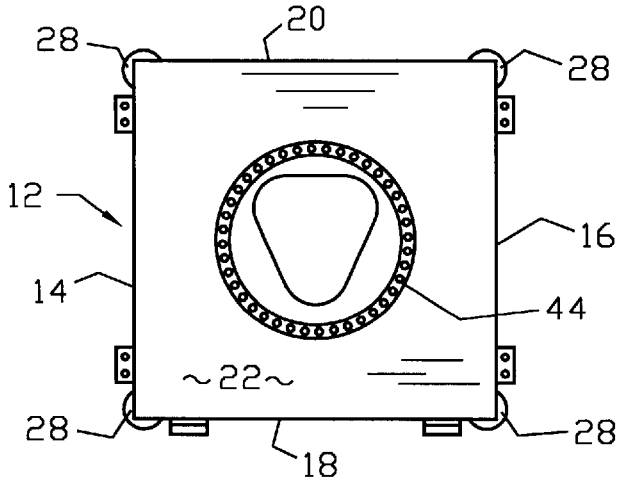
FIG. 3*a* is a top plan view of the base of the bathing chair.
Figure 3B:
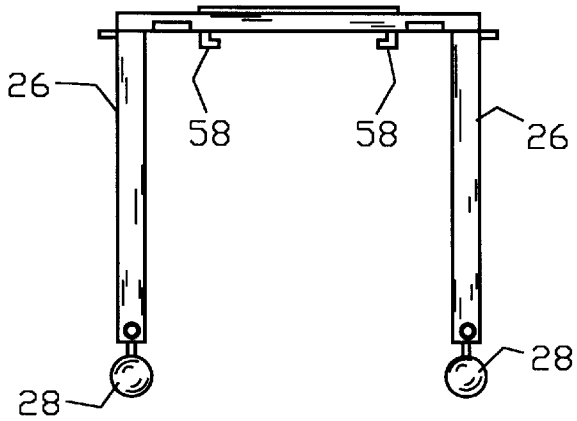
FIG. 3*b* is a front elevation view of the base of the bathing chair.
Figure 3C:
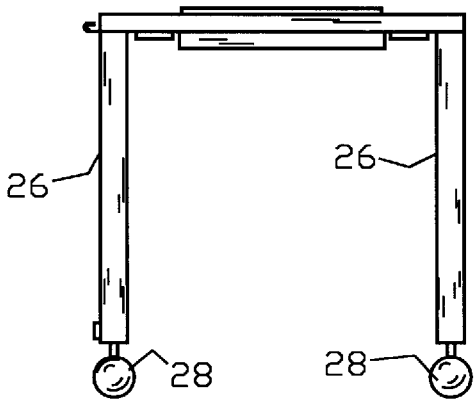
FIG. 3*c* is a side elevation view of the base of the bathing chair.
Figure 3D:
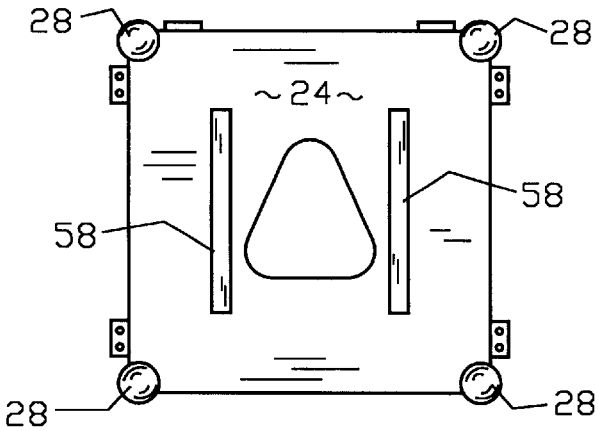
FIG. 3*d* is a bottom plan view of the base of the bathing chair.
Figure 4A:
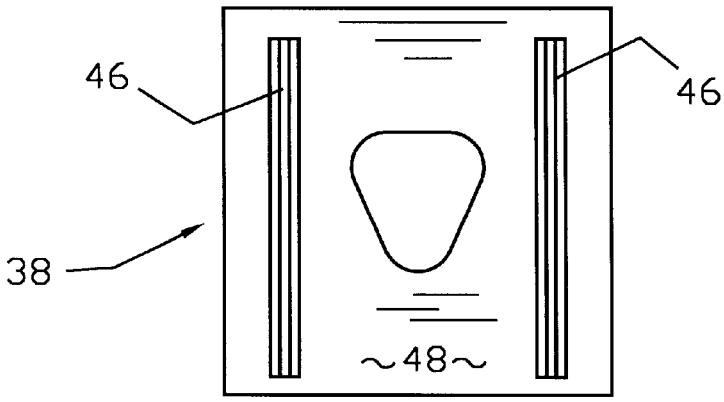
FIG. 4*a* is a top plan view of the first plate member of the bathing chair.
Figure 4B:
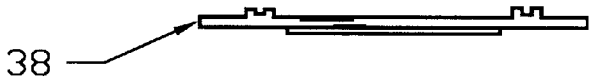
FIG. 4*b* is a front elevation view of the first plate member of the bathing chair.
Figure 4C:
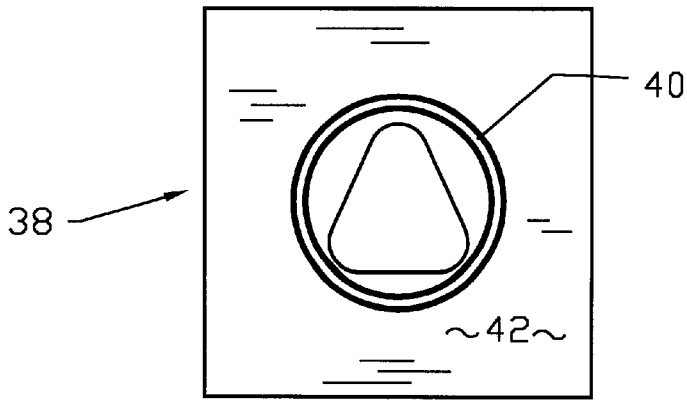
FIG. 4*c* is a bottom plan view of the first plate member of the bathing chair.
Figure 5A:
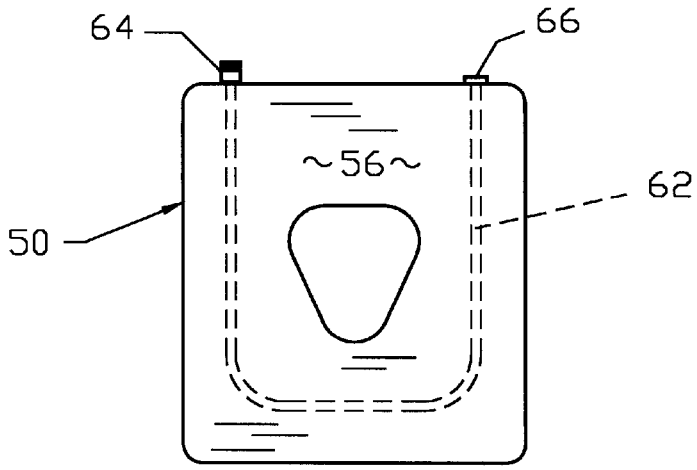
FIG. 5*a* is a top plan view of the second plate member of the bathing chair.
Figure 5B:
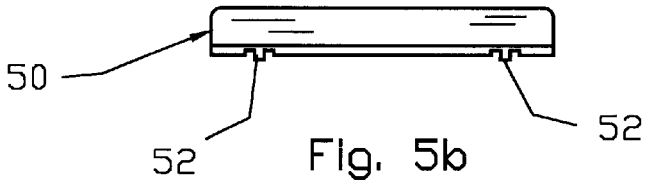
FIG. 5*b* is a front elevation view of the second plate member of the bathing chair.
Figure 5C:
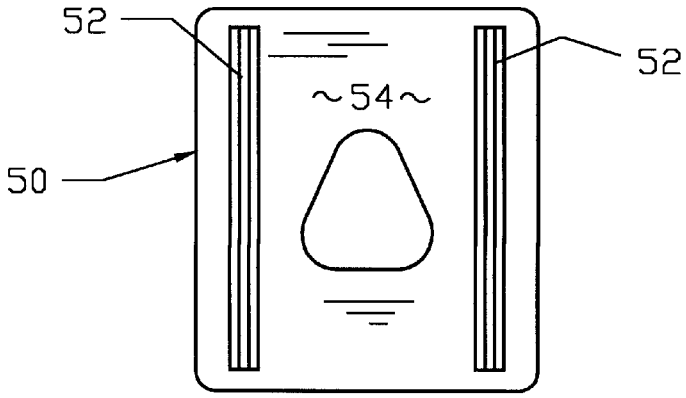
FIG. 5*c* is a bottom plan view of the second plate member of the bathing chair.
Figure 6A:
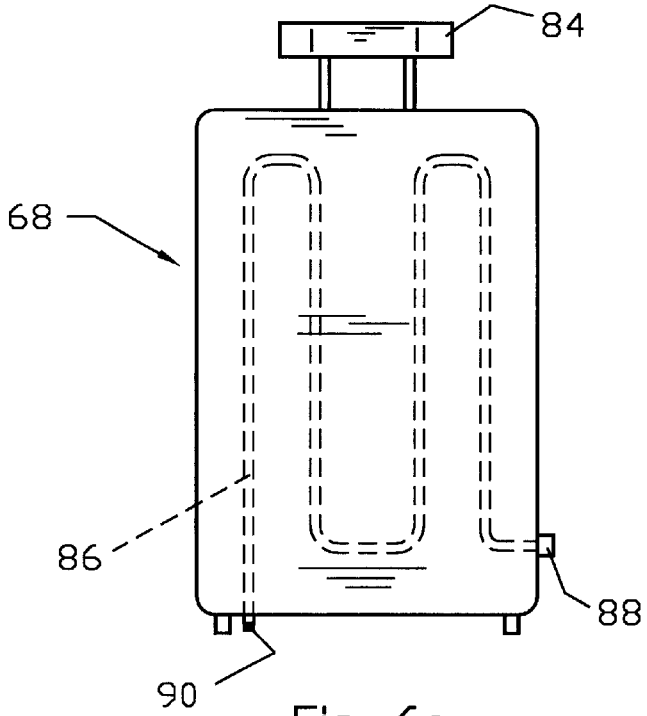
FIG. 6*a* is a front elevation view of the back member of the bathing chair.
Figure 6B:
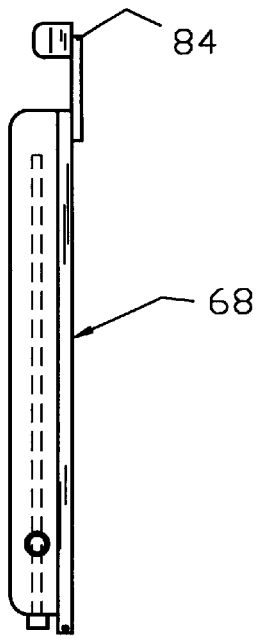
FIG. 6*b* is a side elevation view of the back member of the bathing chair.
Figure 6C:
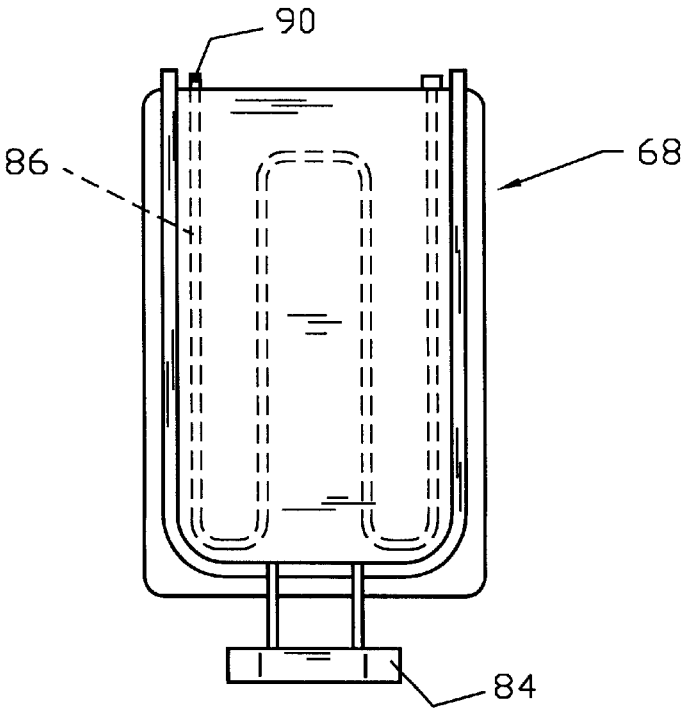
FIG. 6*c* is a rear elevation view of the back member of the bathing chair.
Figure 7A:
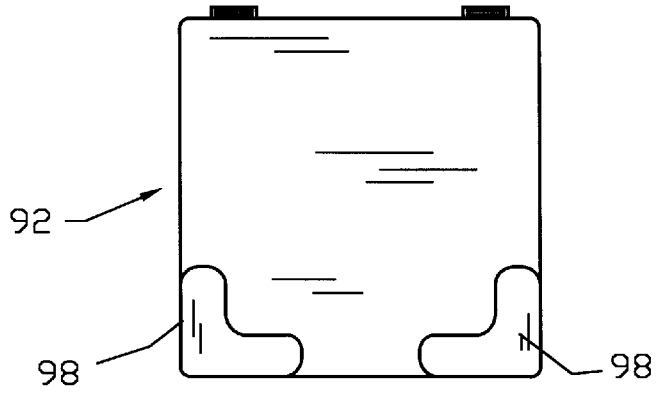
FIG. 7*a* is a front elevation view of the back member of the bathing chair.
Figure 7B:
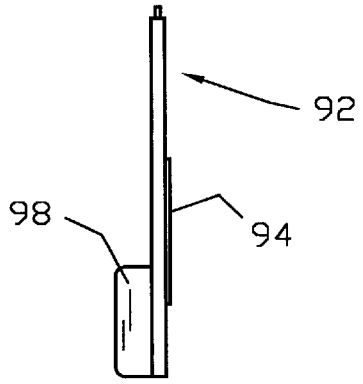
FIG. 7*b* is a side elevation view of the back member of the bathing chair.
Figure 7C:
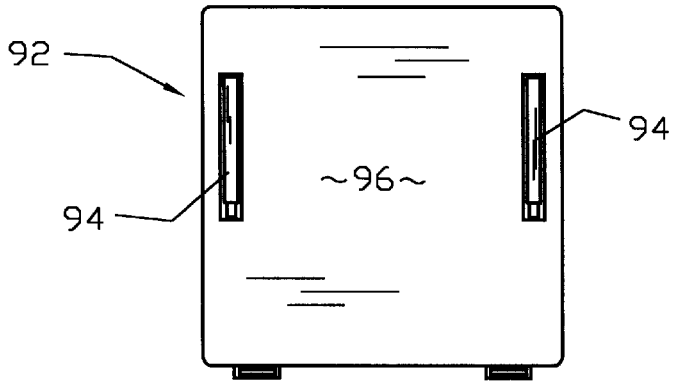
FIG. 7*c* is a rear elevation view of the back member of the bathing chair.
Figure 8:
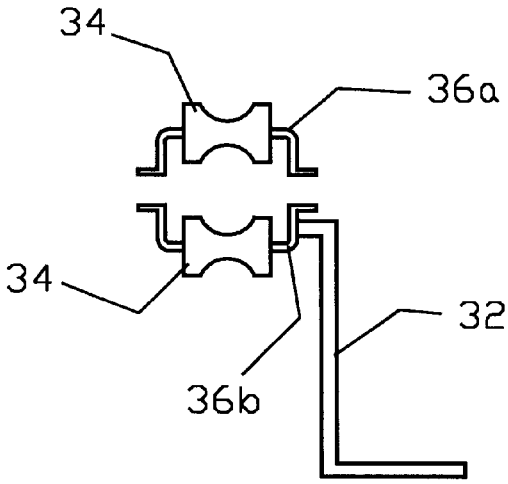
FIG. 8 is a close-up view of the roller and spindle system of the hand rails.
Figure 9:
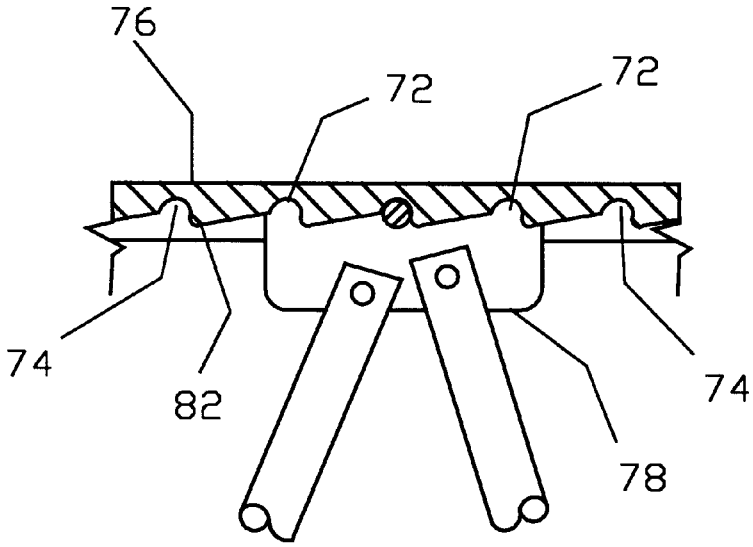
FIG. 9 is a close-up view of the tongue and groove system of the hand rails.

Referring now to the drawings, it is seen that the bathing chair of the present invention, generally denoted by reference numeral 10, is comprised of a base 12 having a a first side 14, a second side 16, a front 18, a back 20, a top 22 and a bottom 24. A plurality of first legs 26 extend downwardly from the bottom 24 of the base 12. A plurality of first castors 28 may be attached to the first legs 26, one castor 28 per leg 26. A seat member 30 is attached to the top 22 of the base 12. An arm 32 extends outwardly from the first side 14 of the base 12 while a pair of generally parallel oriented rollers 34 are attached to respective spindles 36*a* and 36*b* located on an end of the arm 32, the rollers 34 adapted to engage the top and bottom of a guide rail found within a bathing environment. The rollers 34 prevent the device 10 from tipping and allow the device 10 to move back and forth along the guide rail. The upper spindle 36*a* is bolted to the lower spindle 36*b* in order to allow rapid engagement and disengagement of the two spindles 36*a* and 36*b* to one another. As seen, the arm 32 may be comprised of a plurality of leg sections in order to raise the position of the rollers 34 above the point of arm 32 attachment to the base 12 for proper engagement with the guide rail.

The seat member 30 may be rotatably attached to the base 12. The rotatable attachment of the seat member 30 to the base 12 can take any form known in the art. As seen, the lower portion of the seat member 30 is comprised of a first plate member 38 that has a ring case 40 located on the bottom surface 42 thereof. The ring case 40 is positioned over top and engaged with a bearing ring 44 located on the top surface 22 of the base 12. The engaged structure allows the first plate member 38 to rotate with respect to the base 12 about the bearing ring 44. A pair of rails 46 are located on the top surface 48 of the first plate member 38 while a second plate member 50 has a pair of extensions 52 on its bottom surface 54, the extensions 52 being removably receivable within the pair of rails 46 located on the first plate member 38. Sliding the extensions 52 into the rails 46 couples the second plate member 50 with the first plate member 38. The top surface 56 of the second plate member 50 acts as the actual seating surface for a user and may be padded.

A series of corresponding openings are located on the base 12, the first plate member 38, and the second plate member 50. A pair of parallel disposed flanges 58 are located on the bottom surface 24 of base 12. A pan 60 is removably receivable between the pair of flanges 58 and is positioned over the openings in order to act as a toilet pan for a user. The pan 50 can be quickly removed for emptying and cleaning. A first conduit 62 is disposed within the second plate member 50, the first conduit 62 having an inlet port 64 that is adapted to be attached to a source of pressurized water and an outlet port 66.

A back member 68, which may also be padded, is pivotally attached to the seat member 30. The back member 68 reclines as desired. A pair of hand rails 70 are attached to the seat member 30 and to the back member 68 and have a tongue 72 and groove system 74 in order to hold the back member 68 is the desired position of recline. In order to change a position of recline of the back member 68, the upper arm 76 of the hand rail 70 is lifted and the back member 68 is positioned as desired. Thereafter the upper arm 76 is lowered and the tongue 72 on the flange plate 78 that is attached to the lower arms 80 is positioned into corresponding groove 74 located on the lower surface of the upper arm 76, thereby holding the back member 68 in place. One-way ramps 82 can be located between adjacent grooves 74 so that movement of the back member 68 in one direction (e.g. raising the back member 68) is relatively easy compared to movement of the back member 68 in the opposite direction. A head rest 84 may be attached to the back member 68 and may be adjustable. A second conduit 86 is disposed within the back member 68, and has an inlet port 88 and an outlet port 90. The inlet port 88 of the this second conduit 86 is either connected to a source of pressurized water or is fluid flow connected to the outlet port 66 of the first conduit 62 disposed within the second plate member 50 (or alternately, the outlet port 90 of the second conduit 86 can be fluid flow connected to the inlet port 64 of the first conduit 62 and the inlet port 88 of the second conduit 86 is connected to the source of pressurized water.

A leg member 92 is pivotally attached to the seat member 30. A hinge element 94 is attached to the back surface 96 of the leg member 92 and to the forward positioned first legs 26 in order to hold the leg member 92 in various positions of recline. A pair of foot extensions 98 is attached to the front surface 100 of the leg member 92 in order to receive the feet of a user.

A cart 102 may be removably attached to the second side 16 of the base 12 by any appropriate coupling means, the cart 102 having a top plate 104 and a plurality of second legs 106 extending downwardly therefrom. A plurality of second castors 108 may be attached to the second legs 106, one castor 108 per leg 106.

In order to use bathing chair 10 of the present invention, the device 10 is positioned within a bathing environment such as a bathtub or shower. The upper spindle 36*a* is disengaged from the lower spindle 36*b* and the rollers 34 engage the guide rail found within the bathing environment. Thereafter, the two spindles 36*a* and 36*b* are re-engaged to one another. The seat member 30 is rotated so as to permit a user to comfortably enter the device 10 and be seated thereon. The seat member 30 is then counterrotated back into position for proper bathing position. The device 10 is rolled into position as desired. The back member 68 and the leg member 92 are each positioned for maximum user comfort. If the head rest 84 is adjustable, it too is adjusted as desired. If desired, a pan 60 is positioned between the flanges 58 underneath the openings. The inlet port of the first conduit 62 and/or the second conduit 86 (depending on configuration) is attached to a source of pressurized water with the water being at a comfortable temperature for the user. As the water passes through the conduits 62 and 86, the heat is transferred to the user. The water can be discharged through the appropriate outlet port 66 or 90 and is allowed to be drained through the bathtub or shower drain. If needed, the cart 102 is attached to the base 12 and is used by either the user of the bathing chair 10 or by a caregiver.

While the invention has been particularly shown and described with reference to an embodiment thereof, it will be appreciated by those skilled in the art that various changes in form and detail may be made without departing from the spirit and scope of the invention.

What is claimed is:

1. A bathing chair for use in a bathtub or shower comprising:

a base having a first side, a second side, a front, a back, a top, and a bottom;

a plurality of first legs extending downwardly from the bottom of the base to support said chair on a floor of said bathtub or shower;

a seat attached to the top of the base;

an arm extending generally laterally outwardly from the first side of the base; and a pair of rollers oriented generally parallel to one another in substantially vertical alignment attached to an end of the arm.

2. The bathing chair as in claim 1 wherein the seat is rotatably attached to the base.

3. The bathing chair as in claim 1 wherein the seat is comprised of a seat member and a back member.

4. The bathing chair as in claim 3 wherein the back member is pivotally attached to the seat member.

5. The bathing chair as in claim 3 further comprising a head rest attached to the back member.

6. The bathing chair as in claim 3 further comprising a first conduit disposed within the seat member, the first conduit having a first inlet port adapted to be attached to a source of pressurized water, and a first outlet port.

7. The bathing chair as in claim 6 further comprising a second conduit disposed within the back member, the second conduit having a second inlet port adapted to be attached to the source of pressurized water, and a second outlet port.

8. The bathing chair as in claim 7 wherein the first outlet port is fluid flow connected to the second inlet port.

9. The bathing chair as in claim 3 further comprising a conduit disposed within the seat member, the conduit having an inlet port adapted to be attached to a source of pressurized water, and an outlet port.

10. The bathing chair as in claim 1 further comprising a head rest attached to the seat.

11. The bathing chair as in claim 1 further comprising a conduit disposed within the seat, the conduit having an inlet port adapted to be attached to a source of pressurized water, and an outlet port.

12. The bathing chair as in claim 1 further comprising:

a first opening disposed within the base; and a second opening disposed within the seat and corresponding with the first opening.

13. The bathing chair as in claim 12 further comprising:

a pair of flanges attached to the bottom of the base in spaced apart fashion on opposing sides of the first opening; and a pan slidably disposed on the pair of flanges.

14. The bathing chair as in claim 1 further comprising a plurality of first castors, each first castor attached to a respective one of the plurality of first legs.

15. The bathing chair as in claim 1 further comprising a leg member attached to the front of the seat.

16. The bathing chair as in claim 15 wherein the leg member is pivotally attached to the seat.

17. The bathing chair as in claim 1 further comprising a cart having a plurality of second legs, the cart attached to the second side of the base.

18. The bathing chair as in claim 17 further comprising a plurality of second castors, each second castor attached to a respective one of the plurality of first legs.

* * * * *